US007116264B2

(12) United States Patent
Griesau et al.

(10) Patent No.: US 7,116,264 B2
(45) Date of Patent: Oct. 3, 2006

(54) PROGRAMMABLE UNIVERSAL REMOTE CONTROL UNIT

(75) Inventors: Eugene W. Griesau, Albany, NY (US); Rebecca J. Carlotti, Rotterdam Junction, NY (US)

(73) Assignee: Contec Corporation, Schenectady, NY (US)

( * ) Notice: Subject to any disclaimer, the term of this patent is extended or adjusted under 35 U.S.C. 154(b) by 0 days.

(21) Appl. No.: 11/185,298

(22) Filed: Jul. 20, 2005

(65) Prior Publication Data

US 2006/0001565 A1 Jan. 5, 2006

Related U.S. Application Data

(62) Division of application No. 10/273,804, filed on Oct. 18, 2002.

(51) Int. Cl.
*G08C 19/12* (2006.01)

(52) U.S. Cl. ..... 341/176; 725/38; 455/151.2

(58) Field of Classification Search ..... 341/173, 341/176; 340/825.69, 825.72; 455/151.2; 345/168, 169, 172; 725/38
See application file for complete search history.

(56) References Cited

U.S. PATENT DOCUMENTS 4,251,812 A 2/1981 Okada et al.
4,774,511 A 9/1988 Rumbolt et al.
4,825,200 A 4/1989 Evans et al.
4,855,746 A * 8/1989 Stacy ..... 341/176
4,856,081 A 8/1989 Smith
4,999,622 A 3/1991 Amano et al.
5,020,139 A 5/1991 Keenan
5,187,469 A 2/1993 Evans et al.
5,307,173 A 4/1994 Yuen et al.
5,317,403 A 5/1994 Keenan
5,414,426 A 5/1995 O'Donnell et al.
5,457,448 A * 10/1995 Totsuka et al. ..... 340/825.72
5,608,389 A 3/1997 Matsuzawa
RE35,954 E 11/1998 Levine
5,894,276 A 4/1999 Altidor et al.
5,959,751 A 9/1999 Darbee et al.
5,969,774 A 10/1999 Wininger
5,987,213 A 11/1999 Mankovitz et al.
6,094,239 A 7/2000 Weber
6,107,951 A 8/2000 Katayama et al.
6,346,934 B1 2/2002 Wugofski
6,549,719 B1 4/2003 Mankovitz
6,587,067 B1 7/2003 Darbee et al.

OTHER PUBLICATIONS

Ralph Calabria; Product Review—Marantz RC-2000 Learning Remote Control, Jun. 1997, Secrets of Home Theater and High Fidelity, two pages, Mar. 6, 2002.
Sony RM-AV2000 Remote Control, from EBAY-CO.UK, Gizmos & Gadgets; Remote Central.com; four pages, Mar. 6, 2002.

* cited by examiner

*Primary Examiner*—Albert K. Wong
(74) *Attorney, Agent, or Firm*—Robert P. Michal; Frishauf, Holtz, Goodman & Chick, P.C.

(57) ABSTRACT

A programmable universal remote control unit, settable in one of either a single device mode of operation or a multi-device mode of operation.

9 Claims, 6 Drawing Sheets

PROGRAMMABLE UNIVERSAL REMOTE CONTROL UNIT

CROSS-REFERENCE TO RELATED APPLICATION

The present application is a Division of U.S. patent application Ser. No. 10/273,804 filed Oct. 18, 2002 for PROGRAMMABLE UNIVERSAL REMOTE CONTROL UNIT, the entire disclosure of which is incorporated herein by reference.

FIELD OF THE INVENTION

The present invention relates generally to remote control units, and more particularly, to remote control units for remotely controlling a plurality of devices.

BACKGROUND INFORMATION

Remote control units have gained widespread popularity for use in remotely controlling home entertainment systems, which typically include devices such as a television set, a cable set-top box or converter, a videocassette recorder, and a stereo. Typically each device includes a separate remote control unit for remotely controlling the specific device. This causes an entertainment system user to have a plurality of remote control units which is very cumbersome.

A universal remote control unit has a plurality of operating modes for controlling a plurality of devices. Each operating mode of the universal remote control unit enables the user to remotely control each of the devices. Typically, a universal remote control unit includes a plurality of mode push buttons (e.g., CABLE, TV, and VCR push buttons) which correspond to the different devices to be controlled. The mode push buttons are used to directly change the operating mode of a corresponding device.

Traditionally, changing the operating mode of the universal remote control unit is accomplished by simply pressing the appropriate mode push button (i.e., CABLE, TV or VCR push button) on the remote control unit. For example, with the universal remote control unit in the cable mode, to turn on the cable set-top box, a user presses a POWER push button. Next, if the user wants to turn on the television set, the user must first press the TV push button then the POWER push button. Thereafter, in order to operate the cable set-top box again, the user must then press the CABLE push button before selecting, for example, the channel up or down push buttons on the remote control unit. Later, if the user wishes to turn off the television and the cable set-top box, the user must press the CABLE push button, the POWER push button, the TV push button, and then the POWER push button.

More recently, universal remote control units have been developed wherein mode change is accomplished by first pressing a mode select button (first mode means) followed by the mode power button (second mode means). Once the mode of the remote is selected, turning devices on/off is accomplished by pressing only the mode power button for the desired device.

A drawback with either of the aforementioned universal remote control units is that a user could unintentionally change the operating mode of the universal remote control unit by inadvertently pressing the CABLE, TV or VCR push buttons. Another drawback is that the operation of the universal remote control unit is often confusing, particularly when a user first turns on several devices and desires to control one of the devices without first placing the universal remote control unit in the proper operating mode to control that specific device. A further drawback is that numerous button presses are typically required to turn on/off all of the multiple devices being operated.

Other universal remote control units include a single mode push button instead of separate push buttons corresponding to each of the devices. By pressing the mode push button, the operating mode of the universal remote control unit changes, (i.e., cycles) from one operating mode to the next.

A drawback with this type of universal remote control unit is that it is often necessary to press the mode push button a number of times in order to change from one operating mode to another operating mode. Another drawback is that it is relatively easy for a user to unintentionally change the operating mode of the universal remote control unit by inadvertently pressing the mode push button.

Numerous universal remote controls currently available also offer macro button capability. By definition, macro buttons are buttons that can be programmed by the end-user to store and re-transmit a desired series of button functions from a single key with a single keystroke.

A benefit of a macro button is the ability to reduce to a single keystroke what would normally take several keystrokes on the remote to execute. However, a drawback of these macro buttons is that they require a relatively complex series of button presses in a precise order for the user to program.

SUMMARY OF THE INVENTION

Therefore, there is a need for a universal remote control unit which can be programmed to operate in a multi-device mode wherein the user can operate different devices, or in a fixed mode (i.e. Cable) setting wherein only one device can be operated such that the user does not inadvertently switch to another operating mode. Multi-device operation allows the user to fully operate a plurality of devices while fixed-mode operation only allows the user to fully operate only a single-device (i.e. set-top box), thereby reducing the likelihood of the user unintentionally changing the operating mode of the universal remote control unit.

The above-mentioned objects are achieved by the present invention which provides an easily programmable universal remote control unit for remotely controlling a plurality of devices through the actuation of a single macro key, and which can be user-programmed to fully operate only a single device.

In accordance with one form of the present invention, a programmable universal remote control unit for controlling a plurality of devices, the remote control unit being set in one of either a single device mode of operation or a multi-device mode of operation, includes a transmitter for transmitting an electronic signal to at least one of the plurality of devices to provide operating instructions to the at least one of the plurality of devices, a memory for storing a plurality of operating modes, a processor being operable in said single device and multi-device operating modes to control transmission from said transmitter in response to actuation of said remote control unit, a first input key for receiving a first key stroke, a second input key for receiving a second key stroke, a third input key for receiving a third keystroke, wherein by actuation of said first, second and third input keys with respective first, second and third key strokes, the universal remote control unit is programmable in the single device mode such that only a cable set-up box is controlled, or all of the plurality of devices are controlled, by the universal remote control unit.

In accordance with another form of the present invention a method of programming a universal remote control unit having a plurality of keys, the universal remote control unit being programmable to be in one of either a single device mode of operation or a multi-device mode of operation, for remotely controlling a plurality of devices, includes the steps of:

1) actuating a first key of the plurality of keys;
2) actuating a second key of the plurality of keys;
3) actuating a third key of the plurality of keys, the third key corresponding to one of a single device mode of operation or a multi-device mode of operation.

The above and other objects, features and advantages of the present invention will become readily apparent from the following detailed description thereof, which is to be read in connection with the accompanying drawings.

DETAILED DESCRIPTION OF THE PREFERRED EMBODIMENTS

Figure 1:
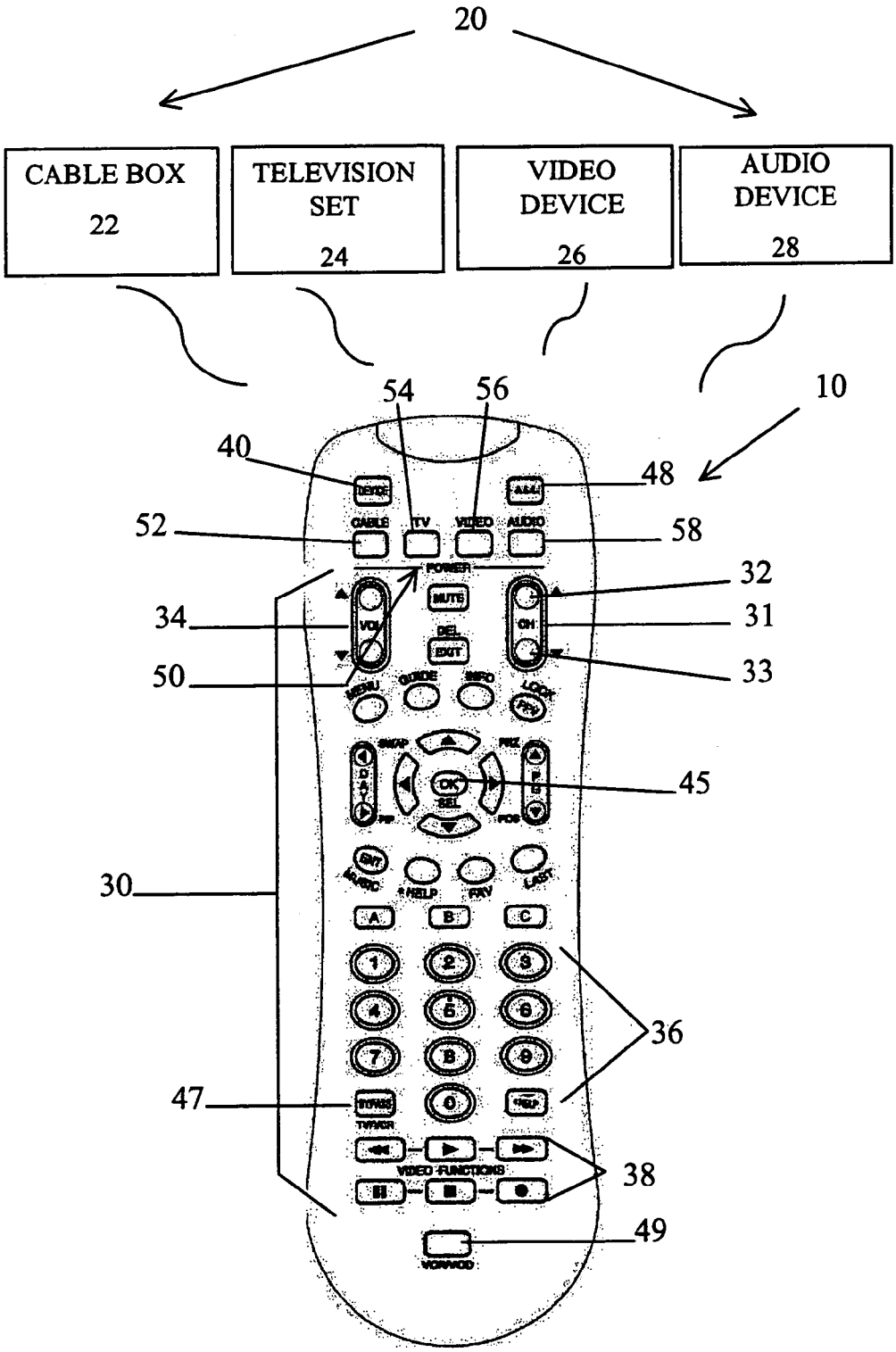
FIG. 1 is front plan view of one embodiment of a universal remote control unit according to the present invention capable of controlling several devices.

Referring initially to FIG. 1 of the drawings, an exemplary universal remote control unit 10 of the present invention for controlling a plurality of devices 20 is shown. As will be explained in greater detail below, universal remote control unit 10 is configured to reduce the likelihood of unintentionally changing the operating mode of the remote control unit and to easily program a SmartKey™ so that one keystroke will operate multiple devices.

Examples of the plurality of devices 20 which may be controlled by the universal remote control unit 10 include a cable set-top box or converter 22, a television set 24, a video device 26 such as a videocassette recorder, a digital video disk (DVD) player, a personal video recorder (PVR), a laser-disk (LD) player, and an audio device 28 such as an amplifier, surround sound audio system, a digital music converter, or an audio-video receiver.

With reference to FIG. 1, universal remote control unit 10 includes an input device 12 (FIG. 2) which may include function means and/or a keyboard 30 for enabling a user to select a plurality of functions in connection with the operation of the plurality of devices 20. As best shown in FIG. 1, keyboard 30 may include a CHANNEL push button 31, a VOLUME push button 34, a plurality of numbered push buttons 36, and a plurality of video function push buttons 38.

In addition, as explained in greater detail below, input device 12 (FIG. 2) also includes a DEVICE push button 40 for initiating a mode change, and a plurality of mode push buttons 50 such as a CABLE push button 52, a TV push button 54, a VIDEO push button 56, and an AUDIO push button 58 for placing universal remote control unit 10 in a respective one of a plurality of operating modes. For example, universal remote control unit 10 in its cable mode operates the functions of the cable box 22. In its television mode, universal remote control unit 10 operates the functions of television set 24. Desirably, as explained below, each of the plurality of mode push buttons may be illuminable having, for example, a backlit light-emitting diode.

Figure 2:
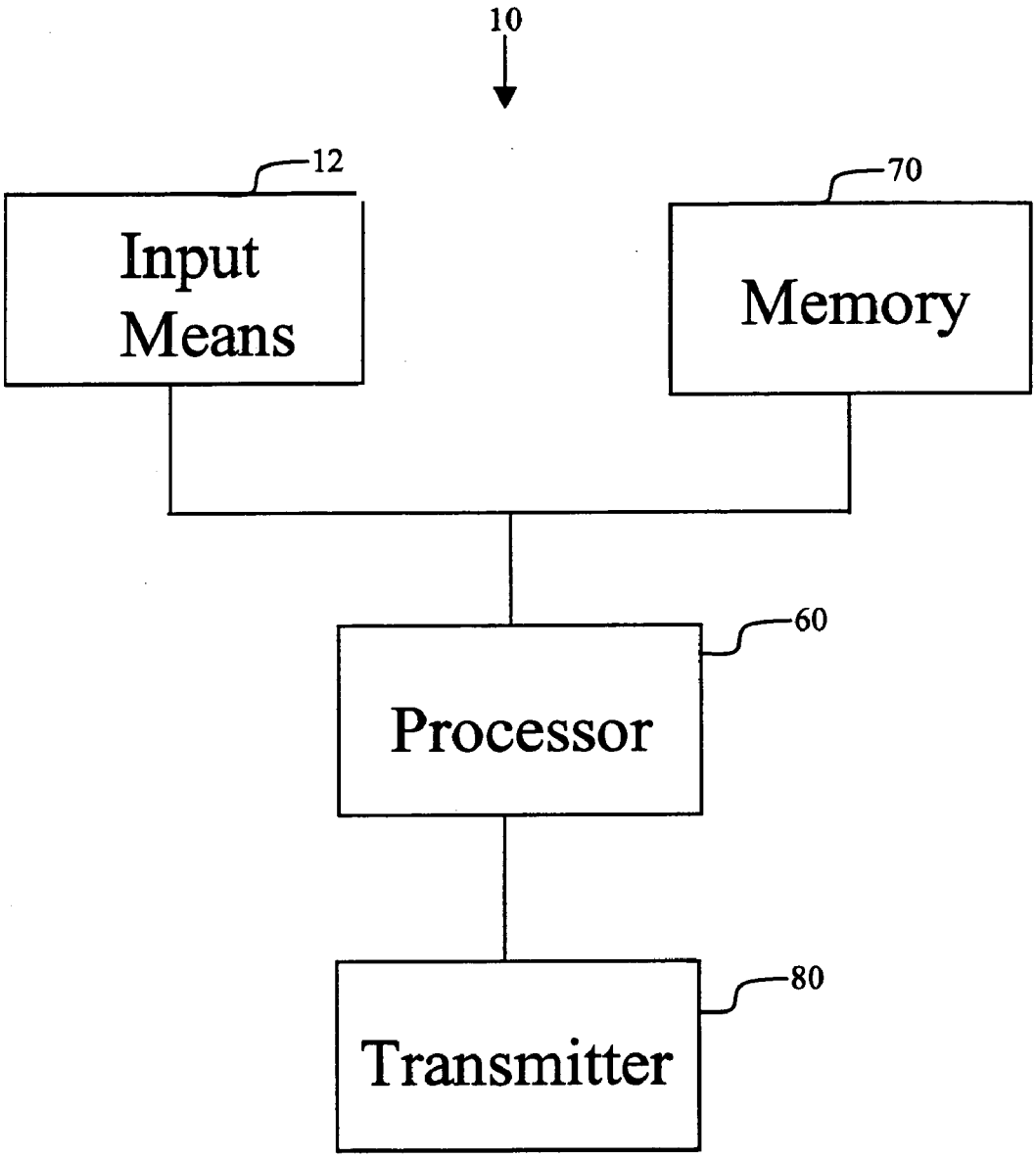
FIG. 2 is a block diagram of the universal remote control unit shown in FIG. 1.

With reference to FIG. 2, universal remote control unit 10 includes, in addition to input means 12, a processor 60, a memory 70 for storing a plurality of operating modes, and a transmitter 80. Activation of one of the plurality of push buttons of keyboard 30 (FIG. 1) by a user generates a command signal when depressed. This command is supplied to processor 60. In response thereto and as known in the art, processor 60 retrieves an appropriate control code from memory 70. Processor 60 then causes transmitter 80 to generate pulses in accordance with the control code retrieved from memory, which are received by one of the plurality of devices 20 (FIG. 1) thereby causing one of the controlled devices, e.g., cable box 22, television 24, video device 26, or audio device 28, to carry out the command function.

Preferably, processor 60 is a programmable infrared (IR) low-voltage micro controller device such as Part No. GMS344XXXT from LG (Goldstar) Semicon Co., Ltd. of Korea. The processor is run by application software or programming, (e.g., assembly language) and is typically governed by the manufacturer's protocol. The devices can be a single package design or multiple package design with external or additional memory storage from the processor.

The invention is not limited to such a processing environment, however. The present invention can be incorporated and be used within many types of processing environments. From the following description, computer readable program code means for use in processor 60 and for implementing the present invention may be readily programmed by those skilled in the art and stored in memory 70 such as a memory chip or an integrated circuit.

Figure 3:
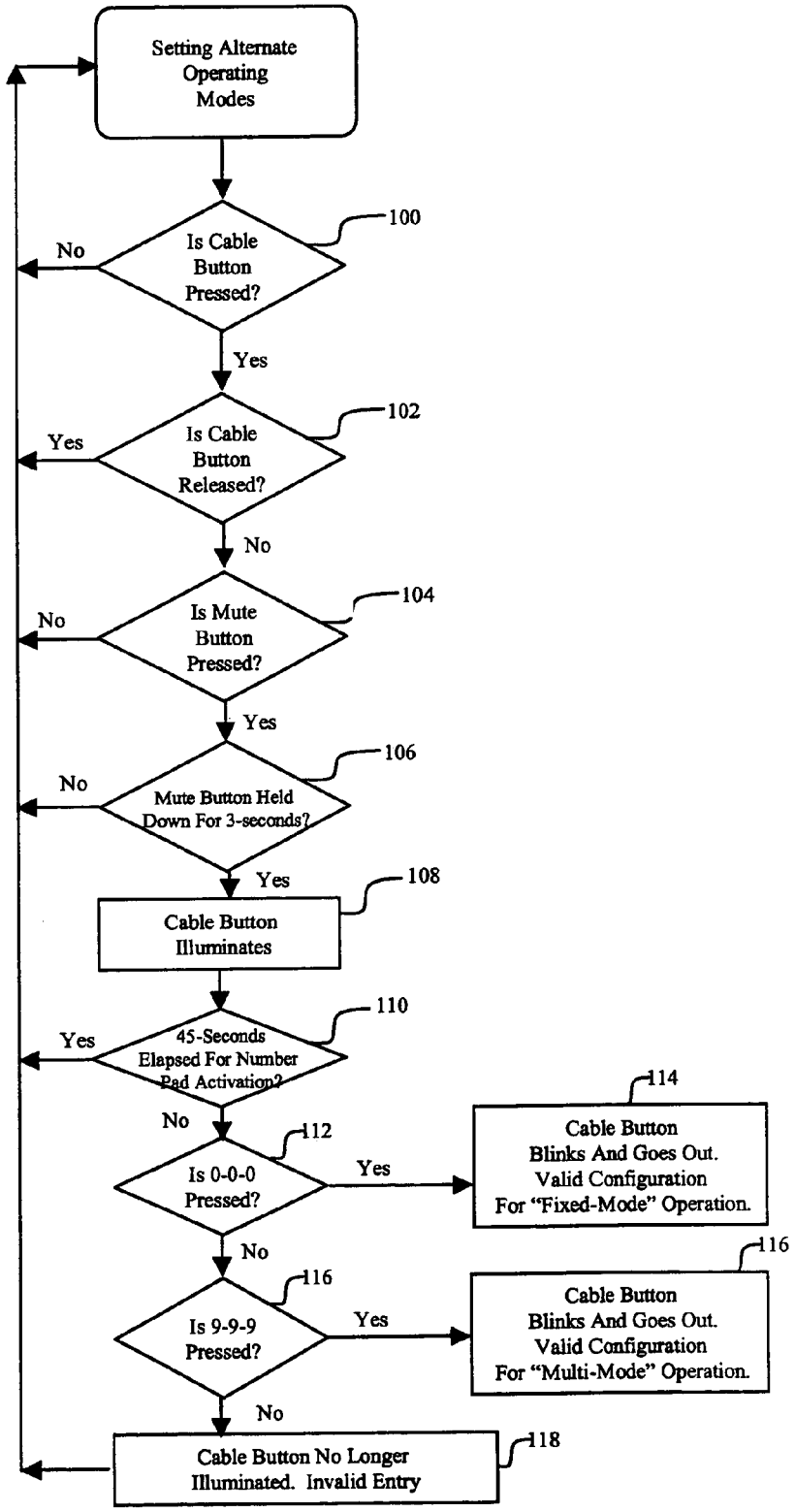
FIG. 3 is a flow chart for programming the remote control unit shown in FIG. 1 to be in either fixed or multi-mode operation.

Referring now to FIG. 3, a method of programming the universal remote control unit to operate in either a plurality of operating modes for remotely controlling a plurality of devices with each of the plurality of operating modes corresponding to a different one of the plurality of devices, or operating in a single operating mode to control a single device is shown. Such a method "locks" the universal remote control unit to a single operating mode or "unlocks" the universal remote control unit to operate a plurality of devices.

In order to program the universal remote control device in either a fixed mode of operation or a multi-mode of operation, the method includes determining whether the cable button on the device has been pressed (step 100). If the cable button has not been pressed, (NO in Step 100) the system continues to monitor the cable button for actuation. However, if the cable button has been pressed (YES in step 100), a determination is made as to whether the button has been released. If the button has been released (YES in step 102), then the method returns to step 100 to monitor the cable button for actuation. If the cable button has not been released (NO in step 102), the mute button is monitored for actuation (step 104). If the mute button has not been actuated (NO in step 104), the method returns to step 100 wherein the cable button is monitored for actuation. If the mute button has been actuated (YES in step 104) within a predetermined period of time, a determination is made as to whether the cable and mute buttons have been simultaneously actuated for at least three seconds (step 106). If the cable and mute buttons have not been simultaneously actuated for at least three seconds (NO in step 106), the method returns to step 100 wherein the cable button is monitored for actuation by the user. If the cable and mute buttons have been simultaneously actuated for at least three seconds (YES in step 106), the cable button illuminates (step 108).

Then, a determination is made as to whether a 45-second time period has elapsed since illumination of the cable button prior to the actuation of another button by the user (step 110). If 45 seconds have elapsed before actuation of another button by the user (YES in step 110), the method returns to step 100 wherein a the cable button is monitored for actuation. If 45 seconds have not elapsed prior to actuation of another button by the user (NO in step 110), a determination is made as to whether specific numbers of the key pad 36 of the universal remote control unit 10 have been pressed. Initially, a determination is made as to whether the digits 000 have been actuated (step 112) within a predetermined time interval (e.g., 5 seconds). If the button corresponding to zero has been pressed three consecutive times (YES in step 112) in a predetermined time interval, then the cable button blinks and returns to a normal non-illuminated state and the universal remote control device is configured for fixed mode operation wherein the universal remote control unit only functions to control the cable set top box (step 114).

If three zeros (the digits 000) have not been sequentially pressed in the predetermined time interval (NO in step 112), then a determination is made as to whether the button corresponding to the number "9" has been pressed three consecutive times in a predetermined time interval (step 116) (e.g., within 5 seconds). If the button corresponding to the number "9" has not been pressed three consecutive times within the predetermined time interval (NO in step 116), then the cable button enters a non-illuminated state (step 118) and the method returns to step 100 wherein the cable button is monitored for actuation by the user. If the button corresponding to the number "9" has been actuated three consecutive times in the time interval (YES in step 116), then the cable button blinks and goes into a non-illuminated state and the universal remote control unit enters a "multi-mode" operation wherein all of the devices are controllable by the remote control unit.

As is evident from the foregoing, pressing the zero button three times within a time interval after simultaneous actuation of the cable and mute buttons will place the universal remote control unit in a single mode or locked operation so that only the cable set-top terminal is controlled by the universal remote control unit. However, by actuating the buttons corresponding to the number "9" three consecutive times within a time interval, after simultaneous actuation of the cable and mute buttons, will unlock the fixed mode operation and return the universal remote control unit to its normal operating state wherein all of the devices of the home entertainment system can be controlled by the universal remote control unit.

Figure 4:
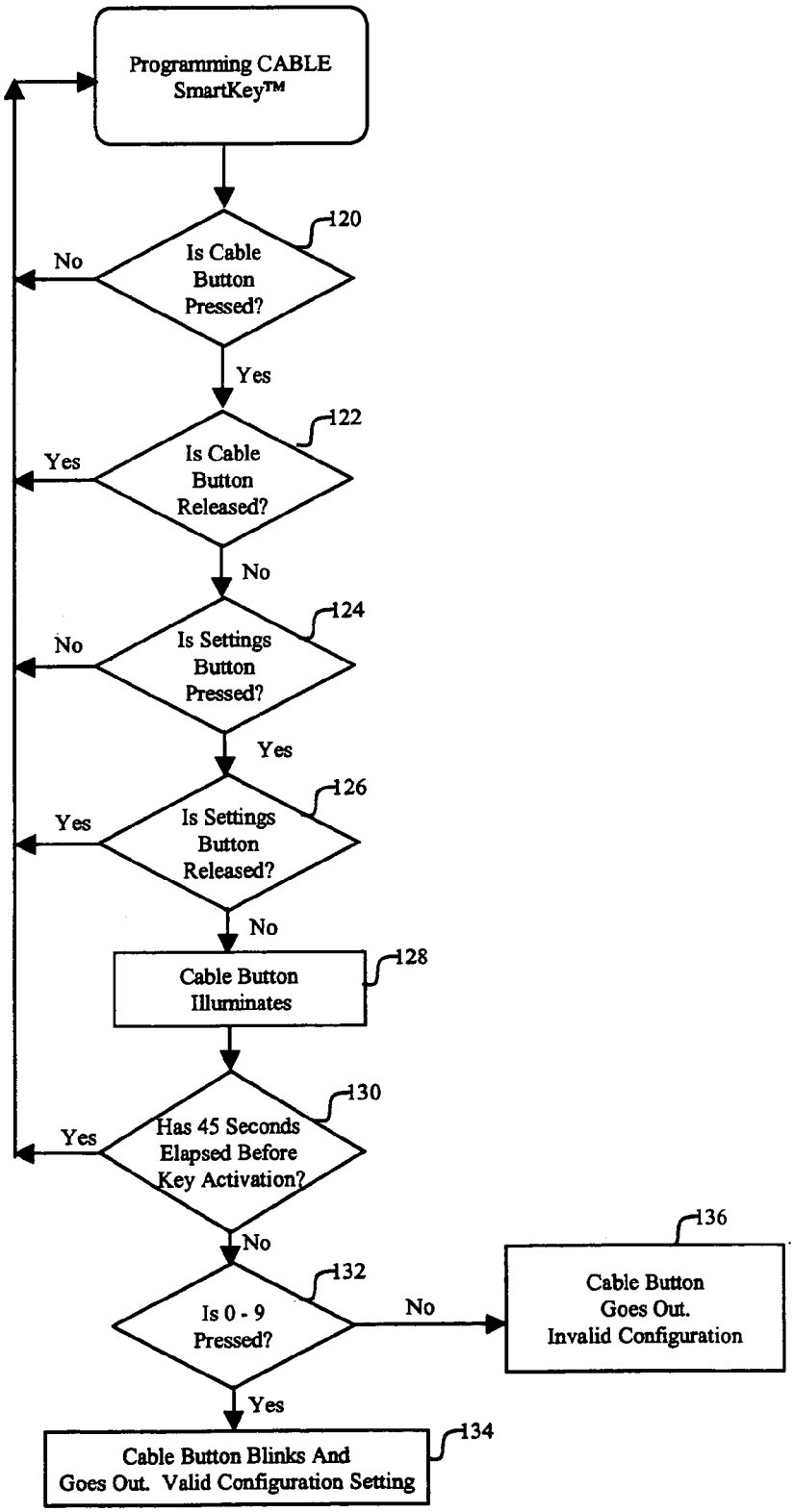
FIG. 4 is a flow chart of a process for programming predetermined macro operations to the cable SmartKey™.
Figure 5:
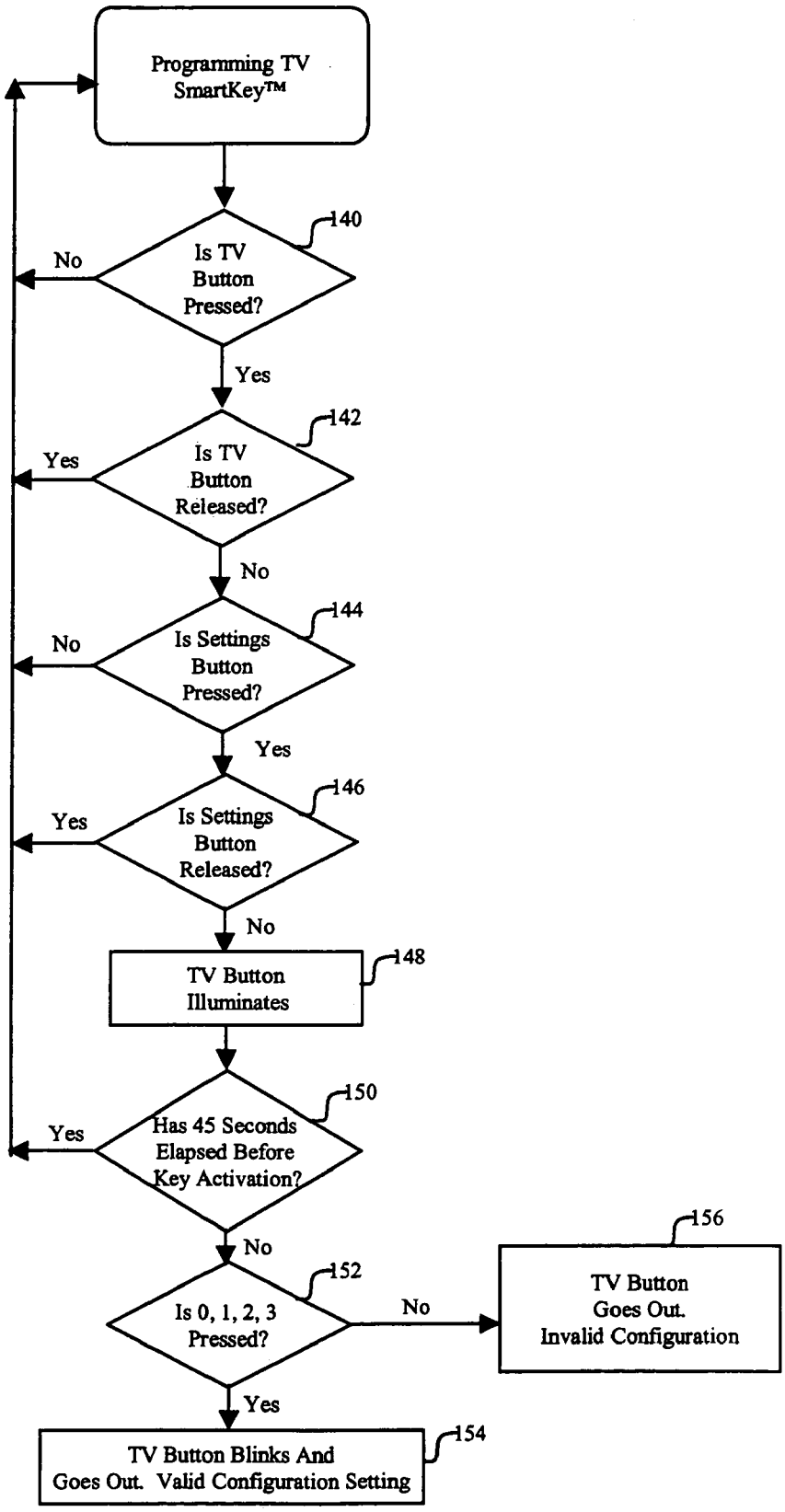
FIG. 5 is a flow chart of a process for programming predetermined macro operations to the TV SmartKey™.
Figure 6:
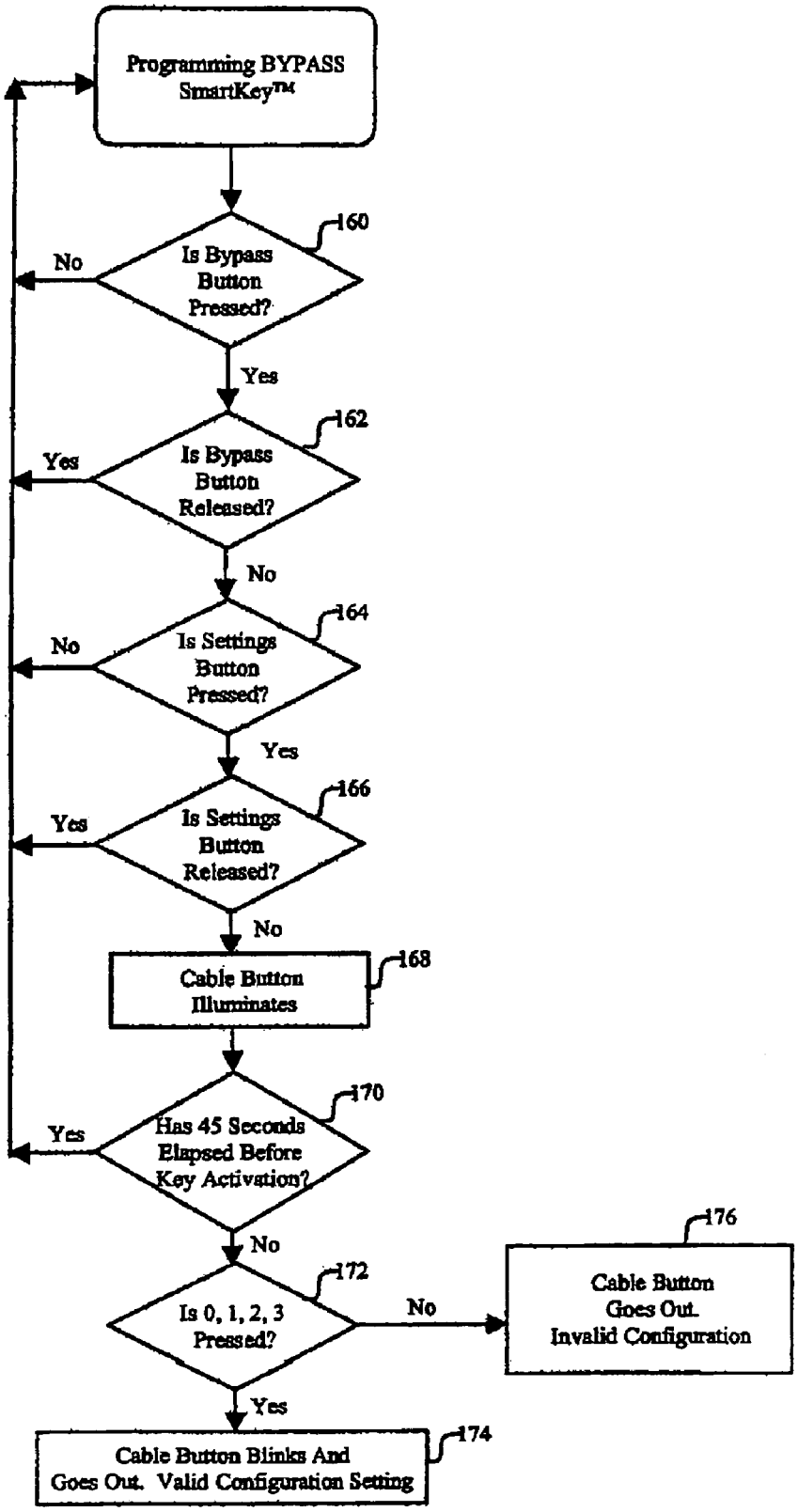
FIG. 6 is a flow chart of a process for programming predetermine macro operations to the bypass SmartKey™.

Referring now to FIGS. 4–6, methods of programming specific buttons on the universal remote control unit so as to provide multiple instructions to the devices included in the home entertainment system are shown. FIG. 4 is directed to programming the cable button as a SmartKey™ using preprogrammed user options. FIG. 5 is directed to programming the TV button as a SmartKey™ using preprogrammed user options. FIG. 6 is directed to programming the bypass key of the universal remote control unit with preprogrammed options.

An advantage of the present claimed invention is that by having preprogrammed options for setting one of the cable, TV and bypass buttons as a SmartKey™ greatly simplifies the programming of these keys.

Referring now to FIG. 4, the method for programming the cable button as a smart key includes determining whether the cable button has been pressed (step 120). If the cable button has not been pressed (NO in step 120), the method continues to monitor the cable button for actuation by the user. If the cable button has been actuated by the user (YES in step 120), then a determination is made as to whether the cable button has been released (step 122). If the cable button has been released (YES in step 122), then the method returns to step 120 wherein the cable button is monitored for actuation by the user. If the cable button has not been released (NO in step 122), then the settings button on the universal remote control unit is monitored for actuation (step 124). If the settings button has not been pressed within a predetermined amount of time after actuation of the cable button (NO in step 124), then the method returns to step 120 wherein the cable button is monitored for actuation by the user. If the settings button is actuated by the user within the predetermined period of time (YES in step 124), then a determination is made as to whether the settings button has been released (step 126). If the settings button has been released in less than the predetermined period of time (YES in step 126), then the method returns to step 120 wherein the cable button is monitored for actuation by the user. If the settings button has been held for at least the predetermined period of time (YES in step 126), the cable button illuminates (step 128) and a determination is made as to whether 45 seconds have elapsed prior to actuation of a button on the numerical keypad 36 portion of the remote control device 10 (step 130). If 45 seconds have elapsed before actuation of a button on the numerical keypad (YES in step 130), the method returns to step 120 wherein the cable button is monitored for actuation. If 45 seconds have not elapsed prior to actuation of a button on the numerical keypad (NO in step 130), then a determination is made as to which button on the numerical keypad was pressed and released (step 132). If one of the digits assigned to a preprogrammed option has been, pressed (YES in step 132), then the cable button blinks and is non-illuminated and the cable button is set for the preprogrammed feature corresponding to the number on the numerical keypad which was pressed in step 132. If the button pressed on the numerical keypad does not correspond to one of the preprogrammed options (NO in step 132), then the cable button is no longer illuminated and the method returns to step 120 wherein the cable button is monitored for actuation.

In the preferred embodiment, the following preprogramming options for input in step 132 are available for the cable smart key:

[1]—turns on CBL+TV and tunes TV to CH 3.
[2]—turns on CBL+TV and tunes TV to CH 2.
[3]—turns on CBL+TV and tunes TV to CH 4.
[4]—turns on CBL+TV+VCR and tunes TV to CH 3.
[5]—turns on CBL+TV+VCR and tunes TV to CH 2.
[6]—turns on CBL+TV+VCR and tunes TV to CH 4.
[7]—turns on CBL+TV+VCR+AUDIO and tunes TV to CH 3.
[8]—turns on CBL+TV+VCR+AUDIO and tunes TV to CH 2.

[9]—turns on CBL+TV+VCR+AUDIO and tunes TV to CH 4.

[0]—returns [CBL] SmartKey™ to normal function.

Referring now to FIG. 5, the method for programming the TV button as a smart key includes determining whether the TV button has been pressed (step 140). If the TV button has not been pressed (NO in step 140), the method continues to monitor the TV button for actuation by the user. If the TV button has been actuated by the user (YES in step 140), then a determination is made as to whether the TV button has been released (step 142). If the TV button has been released (YES in step 142), then the method returns to step 140 wherein the TV button is monitored for actuation by the user. If the TV button has not been released (NO in step 142), then the settings button on the universal remote control unit is monitored for actuation (step 144). If the settings button has not been pressed within a predetermined amount of time after actuation of the TV button (NO in step 144), then the method returns to step 140 wherein the TV button is monitored for actuation by the user.

If the settings button is actuated by the user within the predetermined period of time (YES in step 144), then a determination is made as to whether the settings button has been released (step 146). If the settings button has been released in less than the predetermined period of time (YES in step 146), then the method returns to step 140 wherein the TV button is monitored for actuation by the user. If the settings button has been held for at least the predetermined period of time (YES in step 146), the TV button illuminates (step 148) and a determination is made as to whether 45 seconds have elapsed prior to actuation of a button on the numerical keypad 36 portion of the remote control device 10 (step 150). If 45 seconds have elapsed before actuation of the numerical keypad (YES in step 150), the method returns to step 140 wherein the TV button is monitored for actuation. If 45 seconds have not elapsed prior to actuation of a digit on the numerical keypad (NO in step 150), then a determination is made as to which button on the numerical keypad was pressed and released (step 152). If one of the digits assigned to a preprogrammed option has been pressed (YES in step 152), then the TV button blinks and is non-illuminated and the TV button is set for the preprogrammed feature corresponding to the number on the numerical keypad which was pressed in step 152. If the button pressed on the numerical keypad does not correspond to one of the preprogrammed options (NO in step 152), then the TV button is no longer illuminated and the method returns to step 140 wherein the TV button is monitored for actuation.

In the preferred embodiment, the following preprogramming options for input in step 152 are available for the TV SmartKey™:

[1]—turns on TV and tunes TV to CH 3.

[2]—turns on TV and tunes TV to CH 2.

[3]—turns on TV and tunes TV to CH 4.

[0]—returns TV push button to normal function.

Referring now to FIG. 6, the method for programming the bypass button as a SmartKey™ includes determining whether the bypass button has been pressed (step 160). If the bypass button has not been pressed, the method continues to monitor the bypass button for actuation by the user (NO in step 160). If the bypass button has been actuated by the user (YES in step 160), then a determination is made as to whether the bypass button has been released (step 162). If the bypass button has been released (YES in step 162), then the method returns to step 160 wherein the bypass button is monitored for actuation by the user. If the bypass,button has not been released (NO in step 162), then the settings button on the universal remote control unit is monitored for actuation (step 164). If the settings button has not been pressed within a predetermined amount of time after actuation of the bypass button (NO in step 164), then the method returns to step 160 wherein the bypass button is monitored for actuation by the user.

If the settings button is actuated by the user within the predetermined period of time (YES in step 164), then a determination is made as to whether the settings button has been released (step 166). If the settings button has been released in less than the predetermined period of time (YES in step 166), then the method returns to step 160 wherein the bypass button is monitored for actuation by the user. If the settings button has been held for at least the predetermined period of time (YES in step 166), the cable button illuminates (step 168) and a determination is made as to whether 45 seconds have elapsed prior to actuation of a button on the numerical keypad 36 portion of the remote control device 10 (step 170). If 45 seconds have elapsed before actuation of the numerical keypad (YES in step 170), the method returns to step 160 wherein the bypass button is monitored for actuation. If 45 seconds have not elapsed prior to actuation of a digit on the numerical keypad (NO in step 170), then a determination is made as to which button on the numerical keypad was pressed and released (step 172). If one of the digits assigned to a preprogrammed option has been pressed (YES in step 172), then the cable button blinks and is non-illuminated and the bypass button is set for the preprogrammed feature corresponding to the number on the numerical keypad which was pressed in step 172. If the button pressed on the numerical keypad does not correspond to one of the preprogrammed options (NO in step 172), then the cable button is no longer illuminated and the method returns to step 160 wherein the cable button is monitored for actuation.

In the preferred embodiment, the following preprogramming options for input in step 172 are available for the bypass SmartKey™:

[1]—transmit CBL BYPASS function and tunes TV to CH 3.

[2]—transmit CBL BYPASS function and tunes TV to CH 2.

[3]—transmit CBL BYPASS function and tunes TV to CH 4.

[0]—returns BYPASS SmartKey™ to normal function.

Advantageously, from the present description, remote control unit 10 overcomes a number of major operational problems that users of prior art universal remote control units encounter. First, universal remote control unit 10 makes it more difficult for users to unintentionally change operating modes. This is accomplished by allowing the user to lock universal remote control unit 10 in its CABLE operating mode. Second, making the various mode push buttons user-programmable with pre-determined selections further reduces the number of push button presses required to program the mode push buttons for remotely controlling a plurality of devices.

From the present description, it will be appreciated by those skilled in the art that a suitable display, (e.g., liquid crystal display, touch screen or a liquid crystal display having a touch screen) may be used instead of the push buttons for allowing a user to select an operating mode and/or a function for remote control of the devices. In addition, it will be appreciated by those skilled in the art that instead of illuminatable push buttons, one or more light-emitting diodes may be disposed on universal remote control unit to indicate the current operating mode, indicate a change in the operating mode, etc. Further, it will be appreciated that instead of a cable mode button, a digital satellite system receiver button may be provided for controlling such a receiver. As well, as a DVD button may be provided for controlling such a device.

Thus, while various embodiments of the present invention have been illustrated and described, it will be appreciated by those skilled in the art that changes and modifications may be made thereunto without departing from the spirit and scope of the invention.

What is claimed is:

1. A programmable remote control unit for controlling a plurality of devices, the remote control unit being set in one of either a single device mode of operation or a multi-device mode of operation, comprising:

a transmitter for transmitting an electronic signal to at least one of the plurality of devices to provide operating instructions to the at least one of the plurality of devices;

a memory for storing a single device mode of operation or a multi-device mode of operation;

a processor being operable in said single device and multi-device operating modes to control transmission from said transmitter in response to actuation of said remote control unit;

a first input key for receiving a first key stroke;

a second input key for receiving a second key stroke;

a third input key for receiving a third keystroke;

wherein by actuation of said first, second and third input keys with respective first, second and third key strokes, the remote control unit is programmed into the single device mode such that only a cable set-up box is controlled, or the multi-device mode such that all of the plurality of devices are controlled, by the remote control unit input key corresponds to actuation of a button for one of the plurality of devices, the second input key corresponds to actuation of a mute button, and the third input key corresponds to at least one of the numerical keypad buttons.

2. The remote control unit according to claim 1, wherein the first input key corresponds to actuation of a button for one of the plurality of devices, the second input key corresponds to actuation of a mute button, and the third input key corresponds to at least one of the numerical keypad buttons.

3. The remote control unit according to claim 2, wherein the remote control device is set in the single device mode by actuating a cable button, actuating the mute button, and actuating at least one of the numerical keypad buttons.

4. A method of programming a remote control unit having a plurality of keys, the remote control unit being programmable to be in one of either a single device mode of operation or a multi-device mode of operation, for remotely controlling a plurality of devices, the method comprising the steps of:

1)actuating a first key of the plurality of keys;

2)actuating a second key of the plurality of keys;

3) actuating a third key of the plurality of keys, the third key selecting one of a single device mode of operation or a multi-device mode of operation.

5. The method of programming according to claim 4 further comprising the step of:

maintaining actuation of the first key when the second key is actuated.

6. The method of programming according to claim 4 further comprising the step of:

wherein the first key is the cable button and the second key is the mute button.

7. The method of programming according to claim 4 further comprising the step of:

illuminating the first key after a time delay subsequent to actuation of the second key.

8. The method of programming according to claim 4 further comprising the step of:

subsequent to actuation of the second key, determining whether a predetermined amount of time has elapsed prior to actuation of the third key.

9. The method of programming according to claim 4 further comprising the step of:

wherein actuation of the third key corresponds to pressing at least one of a number of buttons of the universal remote control unit.

* * * * *